United States Patent [19]

Crickmer

[11] 4,058,166

[45] Nov. 15, 1977

[54] WELL SETTING TOOL

[75] Inventor: Charles D. Crickmer, Houston, Tex.

[73] Assignee: Otis Engineering Corporation, Dallas, Tex.

[21] Appl. No.: 671,350

[22] Filed: Mar. 29, 1976

[51] Int. Cl.[2] ..... E21B 23/06

[52] U.S. Cl. ..... 166/315; 166/65 M; 166/120

[58] Field of Search ..... 166/315, 65 M, 65 R, 166/120, 212

[56] References Cited

U.S. PATENT DOCUMENTS

| | | | |
|---|---|---|---|
| 2,245,712 | 6/1941 | Ragan | 166/65 M |
| 3,318,384 | 5/1967 | Brown | 166/120 |
| 3,666,030 | 5/1972 | Bohn et al. | 166/65 M |

*Primary Examiner*—James A. Leppink
*Attorney, Agent, or Firm*—Vinson & Elkins

[57] ABSTRACT

A well tool and more particularly a hanger or setting tool actuating assembly for hanging a liner in a well or setting various other well equipment in a desired subsurface position. The actuating assembly includes a magnet which is moved by means controlled remotely therefrom to cause a member magnetically coupled thereto to correspondingly move resulting in setting of the well equipment in the desired location.

24 Claims, 6 Drawing Figures

WELL SETTING TOOL

The invention relates to a well tool for hanging or setting well equipment in a desired position. While the invention can be advantageously utilized to set well equipment such as well heads and blow-out preventers at the head of an off-shore well, the most common use of the tool will be to set liners and packers within a well. For convenience, the invention is described and shown utilized as a liner hanger; however, it is particularly noted that this description of a preferred embodiment should not be construed as limiting the scope of the invention.

In the art of wells, such as oil wells, it is often desirable to coaxially suspend, or set, a tubing or casing liner within a tubular well casing. The device used to suspend the liner is referred to in the art as a liner hanger. Liner hangers may be used to accomplish a wide range of production operations the most important of which is to connect the upper end of a smaller diameter casing within the lower end of a larger diameter casing to eliminate the need for extending the smaller diameter casing all the way up to the surface of the earth. Other uses for liner hangers include: for scabbing operations to protect casing; for water shut-off to protect the well against water encroachment; to separate production zones; or to inject gas or water.

After a liner hanger has been lowered from the surface to a desired location in a well casing by means of drill pipe known in the art as a "run-in" string, the liner hanger may be set by actuating a slip-cone assembly comprising a plurality of circumferentially spaced serrated slips which are axially movable with respect to a tapered cone. Relative axial movement between the slips and cone causes the slips to be wedged radially outward into gripping engagement with the interior wall of the well casing thereby maintaining the liner hanger and dependent liner at the desired location. Thereafter, the run-in string is disconnected from the liner hanger and removed from the well.

Two basic methods have been used in the past for producing the relative axial movement between the slips and the cone. One method is generally referred to as the mechanical method and is exemplified by U.S. Pat. No. 3,195,646 issued July 20, 1965 to Brown. The mechanical method utilizes a slip cage, including belly or drag springs, slidably mounted about a mandrel. As the device is pushed downwardly through the casing, J-pins on the mandrel engage the bottoms of short leg segments of J-slots in the cage pushing the slip cage downwardly in a manner overcoming the friction of the drag springs and thereby holding the slips out of engagement with the cone. When the setting point is reached in the well casing, a slight upward pull on the run-in string and slight rotation to the right will move the pins into the longer leg of the J-slots, thereby releasing the hanger mandrel for longitudinal movement relative to the slip cage. The drag springs serve to hold the slip cage and slips stationary as the run-in string is lowered, moving the cone into engagement with the slips to move the slips radially outwardly against the well casing. As the total weight of the liner is placed on the slips, the latter will be forced into strong anchoring engagement with the wall of the well casing. The run-in string will then be further rotated to disengage the hanger, allowing the removal of the run-in string from the well.

Some of the disadvantages of the mechanical method outlined above are: in very deep wells of the drag springs may wear out before reaching the setting depth, rendering the device inoperative for setting the slips; in very deep and/or highly directional wells the run-in string and/or liner might bind in the well casing to an extent preventing proper J-pin release from the short leg of the J-slot; it is undesirable to rotate the run-in string since the run-in string may become loosened or even completely unscrewed before the liner hanger is set.

Another method which has been used to set the slips of a liner hanger is known as the hydraulic method exemplified by U.S. Pat. No. 3,291,220 issued Dec. 13, 1966 to Mott. The hydraulic type liner hanger uses a run-in string having a setting tool thereon. The setting tool is connected to the liner hanger and is in hydraulic communication through the liner hanger mandrel with an annular hydraulic piston-cylinder assembly connected to the slips. To set the slips, hydraulic fluid flows or is pressurized through the setting tool and through the hanger mandrel to move the piston and slips associated therewith relative to a cone to thereby set the slips.

Some disadvantages of this hydraulic type hanger are: the slips are prone to set prematurely due to insufficient restraint during run-in; providing a piston-cylinder assembly on the liner hanger results in markedly increased costs; if the thin walled cylinder is even slightly dented it could jam the piston and prevent proper operation; the necessity of holes in the hanger mandrel to allow for fluid communication with the piston results in undesirable stress concentrations greatly increasing the chance of breaking the mandrel.

According to the present invention, there is provided a well tool such as a liner hanger assembly which is set magnetically. A setting tool of the present invention is adapted to be releasably secured within a nonmagnetic hanger mandrel portion and includes an axially movable magnet. The setting tool magnet is remotely actuated, preferably by means of pressurized hydraulic fluid. Exterior of the hanger mandrel is a magnetic member of being magnetically coupled with the setting tool magnet for axial movement therewith, and a setting arrangement, such as at least one slip-cone assembly, is actuatable in response to the axial movement of the magnetic member.

It is therefore an object of the present invention to provide a novel well tool which overcomes the above-cited disadvantages of the prior art by utilizing a magnetic force to set a hanger or other well equipment at a desired sub-surface location.

Other objects and advantages will become apparent to one of ordinary skill in the art from the following detailed description of the preferred embodiment of the invention when read in conjunction with the accompanying drawings wherein.

Figure 1:
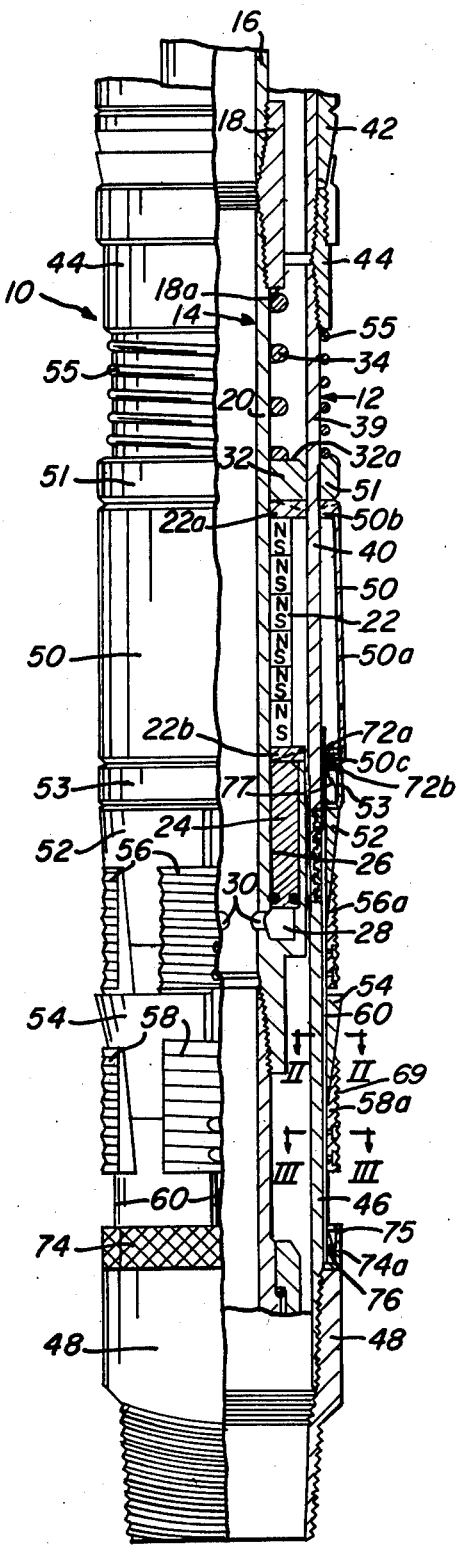
FIG. 1 is a longitudinal, quarter-sectional view of a liner hanger and setting tool therefor according to the principles of the invention, shown in the run-in or non-actuated position.

Referring to the drawings, and FIG. 1 in particular, the invention is shown being utilized as a liner hanger and setting tool assembly 10 depicted in the run-in or nonactuated position. The assembly 10 includes a generally tubular liner hanger 12 and a generally cylindrical setting tool 14 coaxially inserted within the hanger 12. The setting tool 14 is releasably secured to the liner hanger 12 in any well known manner (not shown) such as that described in U.S. Pat. No. 3,291,220 so that the entire assembly 10 may be lowered into a well casing C (FIG. 4) as a unit by a run-in string (not shown) until such time as the liner hanger is positioned at the desired location and set. The setting tool 14 can then be detached and removed therefrom (see FIG. 5).

The setting tool 14 is lowered into a well and supported from the surface by a run-in string (not shown) connected to a setting tool connecting assembly (not shown) which in turn is connected to member 16 and coupling 18. Connected below the coupling 18 is a setting tool tubular mandrel 20 fabricated of a nonmagnetic material such as stainless steel or bronze. (It is noted that for purposes of this specification and the claims the term "nonmagnetic material" refers to any material which will not conduct a substantial amount of magnetic flux and thus will allow the lines of flux to pass directly therethrough substantially unabated, and the term "magnetic material" refers to any material which may be magnetically coupled to a magnet by means of a magnetic force field.) An annular magnet 22 is slidably positioned coaxially around the setting tool mandrel 20 and is preferably fabricated of vertically stacked annular permanent magnets. Directly above and below the magnet structure 22 are situated annular magnetic pole pieces **22*a* and 22*b*** fabricated of soft iron or the like and which may be tapered radially outward as indicated by the broken lines for a purpose to be explained hereinafter.

An annular nonmagnetic piston 24 slidably surrounds mandrel 20 and is positioned below lower pole piece **22*b* within an annular nonmagnetic cylinder 26. The cylinder 26 along with piston 24 define an annular, sealed variable volume hydraulic fluid chamber 28 having circumferentially spaced inlet ports 30 extending through the wall of mandrel 20 to allow hydraulic fluid to pass from the interior of mandrel 20 to the chamber 28 for reasons to be more fully explained hereinafter. Above upper pole piece 22*a* is situated an annular magnetic insulator 32 of nonmagnetic material. A helical compression spring 34 surrounds mandrel 20 and extends between a radially outwardly extending face 18*a* of coupling 18 and a radially outwardly extending face 32*a* of insulator 32. The spring 34 serves to positively bias the setting tool magnet 22 in a nonactuated position until such time as it is desired that it be actuated by pressurizing hydraulic fluid in chamber 28** as will be explained hereinafter.

Figure 4:
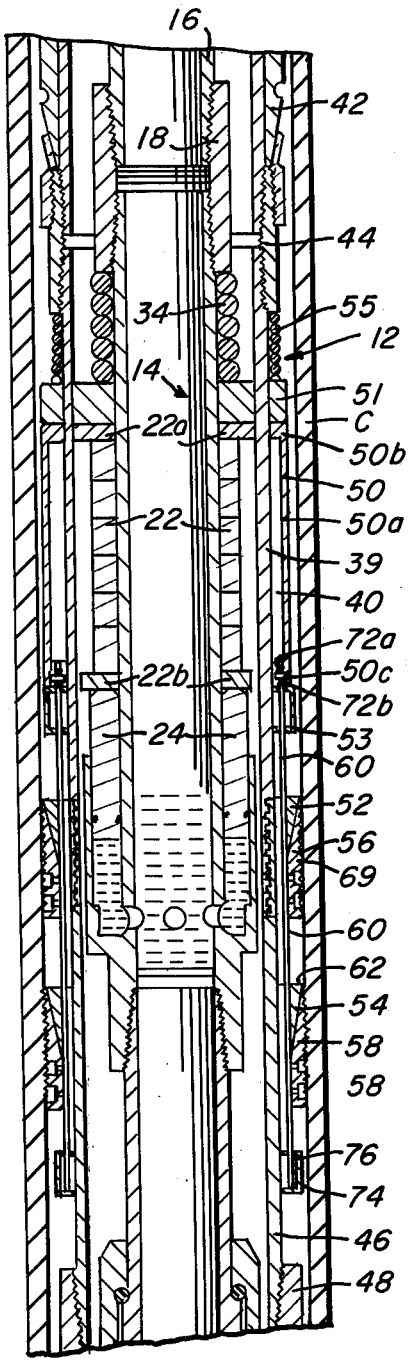
FIG. 4 is a full cross-sectional view of the liner hanger and setting tool therefor in a set position within a well casing.

The liner hanger 12, is, as explained hereinbefore, initially releasably connected to setting tool 14 and extends circumferentially therearound in a coaxial relationship therewith (FIGS. 1 and 4). The liner hanger includes a tubular mandrel 39 comprised of a nonmagnetic portion 40 and preferably a lower mandrel portion 46 of any suitable rigid material attached therebelow in a manner to form smooth interior and exterior surfaces at the junction thereof.

The nonmagnetic portion 40 completely surrounds magnet 22 and pole pieces **22*a*, 22*b* of setting tool 14 and extends vertically a distance at least as great as the extent of possible vertical movement of upper pole piece 22*a*. The upper end of nonmagnetic mandrel portion 40 may be secured to any of a number of well tools such as a well known packer assembly 42 (only a portion of which is shown) by a threaded coupling 44. A conventional coupling 48 is shown on the lower end of mandrel 39** for the connection of a conventional liner (not shown).

Slidably supported on mandrel portion 40 is an annular magnet-follower member 50 of a magnetic material. Member 50 has a tubular main body portion **50*a* which is coaxial with mandrel portion 40 and which is spaced slightly outwardly therefrom by upper and lower radially inwardly extending annular flanges 50*b* and 50*c* which may be tapered radially inwardly as shown by the broken lines for reasons to be explained hereinafter. As shown, the flanges 50*b* and 50*c* are situated to correspond to the vertical positions of respective pole pieces 22*a* and 22*b*. Respectively above and below member 50 are vertically movable annular nonmagnetic members 51 and 53. Placed between the upper member 51 and coupling 44 is a helical compression spring 55 having a low spring force relative to the helical spring 34 on the setting tool 14**.

Figure 2:
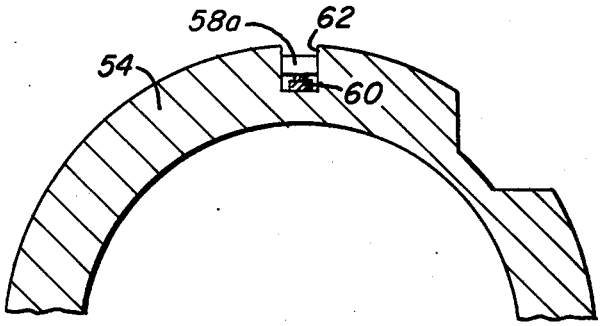
FIG. 2 is an enlarged partial cross-sectional view of the liner hanger per set taken on line II—II of FIG. 1.
Figure 3:
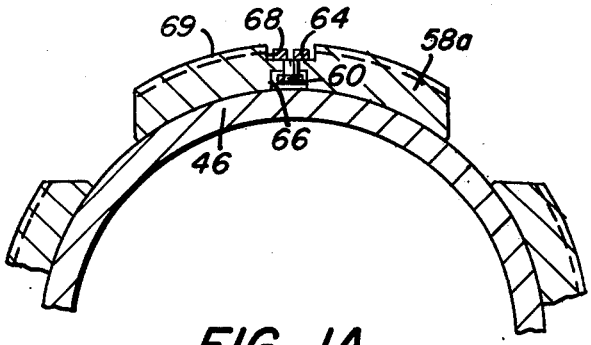
FIG. 3 is an enlarged partial cross-sectional view of the liner hanger per se taken along line III—III of FIG. 1.

Surrounding mandrel 39 are annular tapered members 52 and 54 known in the art as "cones." The cones 52 and 54 may be affixed by any suitable means to mandrel portion 46 and preferably are formed unitarily therewith. As shown, the walls of the cones gradually increase in thickness from the axial lower end to the upper end thereof. Adapted to slidably engage the cones are, preferably, two axially spaced sets of serrated gripping members 56 and 58 known as "slips" in the art. Each set of slips comprises a plurality of individual slips, preferably four, which are equally spaced around the respective cones associated therewith. With particular reference to FIG. 1 it can be seen that eacn individual slip of slip set 56 (for example slip **56*a*) is situated directly above and is connected to an individual slip (in the example, 58*a*) of slip set 58 by a straight rod or rein 60 of which there are four equally spaced around mandrel 39 and which extend in an axial direction with respect thereto. As can be seen in FIG. 2 the reins 60 may pass through cones 52 and 54 without obstruction by means of slots 62 which are formed axially through the cones 52 and 54. The slots 62 also act to constrain the reins 60 to move in a direction parallel to the axis of the mandrel 39 while allowing the reins 60 to move radially with respect to the mandrel 39 to a limited extent. It is noted that between the slots 62, the cones may be either solid as shown on the left side of FIG. 2 or they may be fluted as shown on the right side of FIG. 2, for the purpose of creating a greater fluid flow area between the hanger 12 and the casing C (FIGS. 4 and 5) for reasons well known in the art. With particular reference to FIGS. 1 and 3, it can be seen that the slips of slip sets 56 and 58 are securely attached to the reins 60 by any suitable means such as by screws 64 which pass through the slips into axial slots 66 in the slips to provide a space for the reins to contact the slips without precluding contact of the inner surface of the slips with the mandrel 46. Further, the screw heads are countersunk in the slips as at 68 to allow unobstructed contact between the outer serrated surface 69** of the slips with a well casing when the slips are actuated as will be more fully explained hereinafter.

Figure 1A:
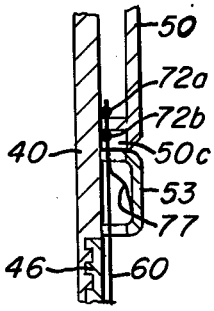
FIG. 1A is an enlarged cross-sectional view of a portion of the liner hanger shown in FIG. 1.

The upper ends of the reins 60 pass through the annular vertically movable magnetic insulator member 53 having slots therethrough for this purpose and also through slots in the lower annular flange 50*c* of member 50 (FIG. 1A). A plurality of pins 72*a* and 72*b* couple the reins to the member 50 for captive vertical movement therewith in a manner allowing the limited radial movement of the reins as will be further explained. The lower ends of the reins 60 are mounted in an annular vertically movable rein housing 74 having an axially extending flange 74*a*. Connected between the lower end of the reins and the flange 74*a* by means of pins 75 is a compression spring means 76, which may be of any suitable construction, biasing the reins radially inwardly yet allowing radial outward movement of the reins upon a sufficient force being exerted to overcome the spring force. It is noted that if desired a compression spring means 77 could also be placed in magnetic insulator member 53 to provide a more positive radial inward bias on the reins.

When it is desired to set the liner hanger in a well casing, the setting tool 14 is mechanically coupled to the liner hanger 12 in a releasable manner by any well known means (not shown) so that the tool 14 and hanger 12 are situated with respect to each other as shown in FIG. 1, i.e., the pole pieces 22*a*, 22*b* of magnet 22 are directly opposite the respective flanges 50*b*, 50*c* of member 50 and are separated by a gap only slightly greater than the thickness of mandrel 39.

The magnet 22 will produce a magnetic field having lines of flux which travel axially through the magnet 22 and which are directed radially outwardly by pole piece 22*a* through non-magnetic mandrel portion 40. The lines of flux then pass into flange 50*b* and axially downward through member 50, body portion 50*a* being of magnetic material, and thence radially inwardly through flange 50*c* passing through mandrel portion 40 back to the lower pole piece 22*b*. The members 32, 51, 53 and 24, all being of non-magnetic material, help to concentrate the lines of flux into the above-enumerated desired path. In order to further concentrate the lines of flux within the gap between the magnet pole pieces 22*a*, 22*b* and the respective flanges 50*b*, 50*c*, it may be desired to taper the pole pieces radially outwardly and the flanges radially inwardly as shown by the broken lines in FIG. 1. In this manner the member 50 will be magnetically coupled to the magnet 22 for axial movement therewith relative to the mandrels 39 and 20.

In operation, the liner hanger and setting tool assembly is lowered in a "run-in" position (FIG. 1) from the surface into a well casing by means of a "run-in" string (not shown). As the assembly is being lowered, relatively strong spring 34 prevents the magnet 22 from moving upward with respect to the mandrels 20 and 39. Due to the above-described magnetic coupling, member 50 is also held stationary with respect to the mandrels which in turn prevents the reins 60 and the slip sets 56, 58 from moving upwardly and prematurally setting in the well casing. Also, the spring 55 aids in preventing premature movement of the member 50; however, it is important to note that spring 55 on liner hanger 12 is not essential for this purpose, but is primarily included in the assembly to return the slips to the run-in position after being set to allow the hanger to be removed or relocated in the well. It can thus be seen that spring 55 may be very thin so as not to add any thickness to the hanger 12. Also, the slips are prevented from moving radially outwardly by spring means 76 in rein housing 74 during the run-in of the assembly.

When the assembly 10 has reached the desired location within the well casing, it may be actuated by pumping hydraulic fluid, for example water, down into connector 16 or pressurizing fluid already present in the run-in string. The pressurized hydraulic fluid passes through ports 30 in mandrel 20 creating a pressure differential on annular piston 24. When the pressure differential on the piston 24 is sufficient to overcome the forces of spring 34 and that of gravity, the piston 24 will be forced upwardly into the position shown in FIG. 4 pushing the magnet 22 upwardly therewith. The magnetic coupling of member 50 described above is of sufficient force to overcome the force of gravity and spring 55 thus moving member 50 upwardly with respect to hanger mandrel 39.

As best seen in FIG. 4, as the member 50 is moved upwardly with respect to mandrel 39 the slip reins 60 are pulled upwardly therewith forcing the slip sets 56 and 58 to slide upwardly upon the respective cones 52 and 54 which are stationary with respect to mandrel 39. As the slips slide upon the cones, it is evident that the slips must move radially outwardly due to the increasing outside diameter of the cones and the matching angle of the inner surface of the slips. The radial force created by the cones is sufficient to overcome the force of the spring means 76 in the rein housing 74; therefore, the reins may follow the respective slips connected thereto in a radial outward direction within the respective cone slots 62. Since the relative movement of the slips of upper slip set 56 is identical to the relative movement of the slips of the lower slip set 58 the reins 60 will always be in parallel relation to the axis of mandrel 39. This design ensures that substantially the entire serrated surfaces 69 of the slips will engage the interior wall of the well casing C to produce a strong engagement therewith.

After the slips have been moved upwardly and outwardly into engagement with the casing C (FIG. 4), the run-in string is lowered slightly to lower the cones with respect to the slips and thereby place the weight of the liner on the slips further driving them radially outward into firm engagement with the inner wall of well casing C. The slips are then able to hold the weight of the entire assembly within the well casing.

Figure 5:
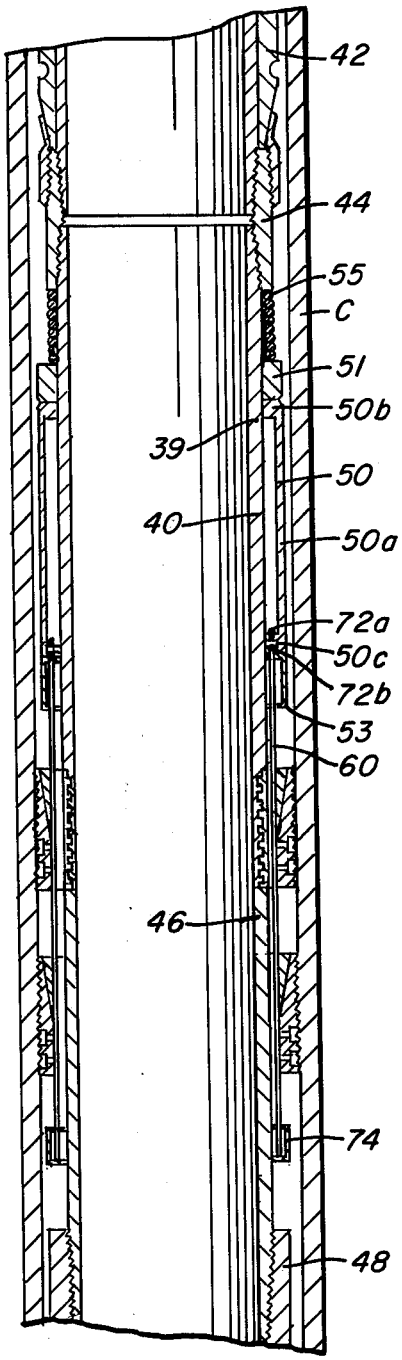
FIG. 5 is a full cross-sectional view of the liner hanger set in a well casing with the setting tool removed therefrom.

After the slips are set in the manner described above, the setting tool 14 is released from engagement with the hanger 12 by well known means, and it may be raised to the surface by the run-in string. Thus, it can be seen that the liner hanger 12 which is a relatively inexpensive assembly is left in the well, while the setting tool 14 which requires more expensive materials such as the piston arrangement 24 and magnet 22 is removed for repeated use (FIG. 5).

If it is desired to relocate the hanger 12 within the well it is only required that the tool 14 be mechanically reconnected to hanger 12 by means of a well known connecting assembly whereby the hanger may be lifted slightly and by means of gravity and the force of spring 55 the slips will fall back into the original position thereof as depicted in FIG. 1. The hanger may then be removed from the well or relocated to another desired position whereafter the above setting operation is again performed.

It is to be particularly noted that while a preferred embodiment of the invention has been described and shown, it is clear that the specific slip arrangement is not necessary to the present invention. For example, the slips may be situated above member 50 and may be pushed upwardly thereby; each slip rein 60 may carry only a single slip instead of the two slip arrangement shown; the member 50 may be connected to the cones to move the cones relative to the slips; the magnet-follower member 50 may be connected to any well known setting device used in other sub-surface operations such as setting well heads on off-shore wells. It is therefore requested that the scope of the invention be limited only by the following claims.

What is claimed is:

1. A well tool and setting tool assembly comprising: a well tool mandrel, at least a portion of which is of non-magnetic material; a setting tool mandrel coaxially and releasably positioned within said well tool mandrel; magnet means carried on the exterior of said setting tool mandrel and movable adjacent said non-magnetic portion of said well tool mandrel between a first and a second axial position; setting means carried on the exterior of said well tool mandrel; a magnetic-follower member of magnetic material carried on the exterior of said non-magnetic portion of said well tool mandrel and axially movable with respect thereto; said magnet means and said member being magnetically coupled wherein axial movement of said magnet means causes corresponding axial movement of said member; and said member being connected to said setting means to set said well tool at a desired location upon axial movement of said member from said first to said second axial position.

2. A well tool and setting tool assembly as specified in claim 1 wherein said setting tool mandrel is of non-magnetic material at least between the axial limits of movement of said magnet means.

3. A well tool and setting tool assembly as specified in claim 1 wherein said setting tool mandrel is substantially cylindrical; and said magnet means is annular and slidably positioned on said setting tool mandrel.

4. A well tool and setting tool assembly as specified in claim 1 wherein said setting means comprises at least one slip-cone assembly.

5. A well tool and setting tool assembly as specified in claim 4 wherein said slip-cone assembly includes axially movable rein means for actuating said slip-cone assembly; said rein means being connected to said magnetic-follower member for axial movement therewith.

6. A well tool and setting tool assembly as specified in claim 1 additionally comprising spring means on said setting tool mandrel for urging said magnet means towards said first position.

7. A well tool and setting tool assembly as specified in claim 1 additionally comprising spring means on said well tool mandrel for urging said magnetic-follower member into said first position.

8. A well tool and setting tool assembly as specified in claim 1 additionally comprising fluid piston-cylinder means mechanically communicating with said magnet means for moving said magnet means from said first position to said second position upon at least a minimum fluid pressure being applied to said piston-cylinder means.

9. A well tool and setting tool assembly as specified in claim 8 wherein said piston-cylinder means comprises an annular cylinder on said setting tool mandrel and an annular piston slidably disposed therein; passageway means communicating the interior of said setting tool mandrel with the interior of said cylinder.

10. A well tool and setting tool assembly as specified in claim 1 wherein:

said magnetic-follower member comprises an annular element having a cylindrical body portion and also having radially inwardly directed annular flanges on each end of said cylindrical body portion; and said flanges are adapted to be in sliding contact with said well tool mandrel.

11. A well tool and setting tool assembly as specified in claim 10 wherein said magnet means includes an annular permanent magnet assembly having annular radially outwardly extending pole pieces on the axial extremities thereof; said pole pieces being in axial locations corresponding to the respective axial locations of said flanges.

12. A well tool comprising:

an elongated tubular mandrel including at least a portion formed of a non-magnetic material;

a magnetic-follower member positioned on the exterior of said tubular mandrel and axially movable along that portion formed of a non-magnetic material between a first position and a second position in response to movement of a magnet within said tubular mandrel;

at least one element of a non-magnetic, insulating material positioned around said tubular mandrel and adjacent each axial end of said magnetic-follower member for confining the magnetic lines of flux to said magnetic-follower member when said magnetic-follower member is affected by a magnet within said tubular mandrel;

means connected to said magnetic-follower member for setting said tool in a desired location when said magnetic-follower member moves from said first position to said second position; and means for releasably connecting said tubular mandrel to an actuating tool so that said actuating tool may be positioned within said tubular mandrel and include at least a portion adjacent said magnetic-follower member.

13. A well tool as specified in claim 12 wherein said tubular mandrel is substantially cylindrical; said magnetic-follower member is annular and includes a cylindrical body portion and radially inwardly directed annular flanges on each end thereof; said flanges being in sliding contact with said mandrel; and said elements of non-magnetic, insulating material being annular and in sliding contact with said tubular mandrel.

14. A well tool as specified in claim 12 wherein said means comprises at least one slip-cone assembly.

15. A well tool as specified in claim 14 wherein said slip-cone assembly includes axially movable rein means for actuating said slip-cone assembly; said rein means being connected to said magnetic follower member for axial movement therewith.

16. A well tool as specified in claim 12 additionally comprising spring means on said tubular mandrel for urging said magnetic follower member into said first position.

17. A setting tool comprising:

an elongated setting tool mandrel;

a magnet structure movable along the exterior of said setting tool mandrel in a direction parallel to the axis of said setting tool mandrel between a first and second position;

actuating means, selectively actuatable remotely from said setting tool mandrel, for moving said magnet structure from said first position to said second position; and means for releasably connecting said setting tool mandrel to a well tool to be set in a well so that said well tool may be positioned around said setting tool and include at least a portion adjacent said magnet structure.

18. A setting tool as specified in claim 17 wherein said setting tool mandrel is of non-magnetic material at least between the axial limits of movement of said magnet structure.

19. A setting tool as specified in claim 17 wherein said setting tool mandrel is substantially cylindrical; and said magnet structure is annular and slidably positioned on said setting tool mandrel.

20. A setting tool as specified in claim 17 additionally comprising spring means on said setting tool mandrel for urging said magnet structure towards said first position.

21. A setting tool comprising:

an elongated setting tool mandrel;

a magnet structure movable along the exterior of said mandrel in a direction parallel to the axis of said mandrel between a first and second position, said magnet structure including an annular permanent magnet assembly having annular radially outwardly extending pole pieces on the axial extremeties thereof; and actuating means, selectively actuatable remotely from said mandrel, for moving said magnet structure from said first position to said second position.

22. A setting tool comprising:

an elongated setting tool mandrel;

a magnet structure movable along the exterior of said mandrel in a direction parallel to the axis of said mandrel between a first and second position;

actuating means, selectively actuatable remotely from said mandrel, for moving said magnet structure from said first position to said second position, said actuating means comprising fluid piston-cylinder means mechanically communicating with said magnet structure for moving said magnet structure from said first position to said second position upon at least a minimum fluid pressure being applied to said piston-cylinder means.

23. A method of setting a well tool utilizing a remotely controlled setting tool in a sub-surface location comprising the steps of:

magnetically coupling a permanent magnet portion of said setting tool to a magnet-follower portion of said well tool by means of a permanent magnetic field prior to positioning said well tool in a well;

positioning the well tool and setting tool therefor at a desired sub-surface location in a well;

moving said permanent magnet portion of said setting tool to correspondingly move said magnetic field with respect to a non-magnetic portion of said well tool located intermediate said setting tool and said magnetic-follower portion to thereby cause said magnetic-follower portion of said well tool to move axially of said non-magnetic portion; and setting said well tool at said sub-surface location in response to the axial movement of said magnetic-follower portion.

24. A method of setting a well tool utilizing a remotely controlled setting tool in a sub-surface location comprising the steps of:

magnetically coupling a magnet portion of said setting tool to a magnetic-follower portion of said well tool by means of a magnetic field;

positioning the well tool and setting tool therefor at a desired location;

pressurizing a fluid within said setting tool to accomplish a moving of said magnet portion of said setting tool to correspondingly move said magnetic field with respect to a non-magnetic portion of said well tool located intermediate said setting tool and said magnetic-follower portion to thereby cause said magnetic-follower portion of said well tool to move axially of said non-magnetic portion; and setting said well tool at said location in response to the axial movement of said magnetic-follower portion.

* * * * *

UNITED STATES PATENT OFFICE
CERTIFICATE OF CORRECTION

Patent No. 4,058,166 Dated November 15, 1977

Inventor(s) Charles D. Crickmer

It is certified that error appears in the above-identified patent and that said Letters Patent are hereby corrected as shown below:

Column 2, line 42 - after the word "member" insert -- capable --.

Column 2, line 65 - delete "set" and insert therefore -- se --.

Column 5, line 37 - delete "non-magnetic" and insert therefore -- nonmagnetic --.

Column 5, line 42 - after the word "to" delete the word "the".

Column 5, line 43 - delete "non-magnetic" and insert therefore -- nonmagnetic --.

Column 5, line 62 - delete "prematurally" and insert therefore -- prematurely --.

Claim 1, line 6 - delete "non-magnetic" and insert therefore -- nonmagnetic --.

Claim 1, line 11 - delete "non-magnetic" and insert therefore -- nonmagnetic --.

UNITED STATES PATENT OFFICE

CERTIFICATE OF CORRECTION

Patent No. 4,058,166 Dated November 15, 1977

Inventor(s) Charles D. Crickmer

It is certified that error appears in the above-identified patent and that said Letters Patent are hereby corrected as shown below:

Claim 2, lines 2 and 3 - delete "non-magnetic" and insert therefore -- nonmagnetic --.

Claim 12, line 3 - delete "non-magnetic" and insert therefore -- nonmagnetic --.

Claim 12, line 6 - delete "non-magnetic" and insert therefore -- nonmagnetic --.

Claim 12, line 10 - delete "non-magnetic" and insert therefore -- nonmagnetic --.

Claim 13, line 7 - delete "non-magnetic" and insert therefore -- nonmagnetic --.

Claim 15, line 4 - delete "magnetic follower" and insert therefore -- magnetic-follower --.

Claim 16, line 3 - delete "magnetic follower" and insert therefore -- magnetic-follower --.

UNITED STATES PATENT OFFICE
CERTIFICATE OF CORRECTION

Patent No. 4,058,166 Dated November 15, 1977

Inventor(s) Charles D. Crickmer

It is certified that error appears in the above-identified patent and that said Letters Patent are hereby corrected as shown below:

Claim 18, line 2 - delete "non-magnetic" and insert therefore -- nonmagnetic --.

Claim 23, line 12 - delete "non-magnetic" and insert therefore -- nonmagnetic --.

Claim 23, line 16 - delete "non-magnetic" and insert therefore -- nonmagnetic --.

Claim 24, line 12 - delete "non-magnetic" and insert therefore -- nonmagnetic --.

Claim 24, line 16 - delete "non-magnetic" and insert therefore -- nonmagnetic --.

Signed and Sealed this

Ninth Day of May 1978

[SEAL]

Attest:

RUTH C. MASON
Attesting Officer

LUTRELLE F. PARKER
Acting Commissioner of Patents and Trademarks